US005657598A

United States Patent [19]

Wilbs et al.

[11] Patent Number: 5,657,598

[45] Date of Patent: Aug. 19, 1997

[54] JOINT-MASKING DEVICE AND METHOD OF ASSEMBLING IT

[75] Inventors: Thomas Wilbs, Ühlingen-Birkendorf; Thomas Speicher, Waldshut-Tiengen, both of Germany

[73] Assignee: alfer-aluminum Gesellschaft mbH, Wutoschinger-Horheim, Germany

[21] Appl. No.: 543,481

[22] Filed: Oct. 16, 1995

[51] Int. Cl.[6] ..... E04B 2/00; E04F 15/14

[52] U.S. Cl. ..... 52/287.1; 52/393; 52/464; 49/467; 403/122

[58] Field of Search ..... 82/287.1, 718.02, 82/716.03, 288.1, 395, 461, 396.06, 393, 464; 403/122, 267; 49/469, 470, 471

[56] References Cited

U.S. PATENT DOCUMENTS

| | | | |
|---|---|---|---|
| 2,273,877 | 2/1942 | Kammerer | 49/467 |
| 3,421,276 | 1/1969 | Barge | 52/287.1 |
| 3,473,278 | 10/1969 | Gossen | 52/718.02 X |
| 3,521,419 | 7/1970 | Fornells | 52/718.02 X |
| 3,659,390 | 5/1972 | Balzer et al. | 52/464 |
| 4,150,517 | 4/1979 | Warner, Sr. | 52/288.1 |
| 4,733,510 | 3/1988 | Werner | 52/202 |
| 4,858,405 | 8/1989 | Christie | 52/476 X |
| 4,887,402 | 12/1989 | Da Col | 52/461 X |
| 4,893,449 | 1/1990 | Kemper | 52/464 |

FOREIGN PATENT DOCUMENTS

| | | | |
|---|---|---|---|
| 8600241 | 4/1986 | Germany . | |
| 3618298 | 12/1987 | Germany | 403/122 |
| 0087798 | 7/1954 | Netherlands | 49/467 |
| 1433583 | 10/1988 | U.S.S.R. | 403/122 |
| 2159572 | 12/1985 | United Kingdom | 403/122 |

*Primary Examiner*—Carl D. Friedman
*Assistant Examiner*—Winnie Yip
*Attorney, Agent, or Firm*—Notaro & Michalos P.C.

[57] ABSTRACT

A joint-masking device (10) for joints in wall or floor coverings consists of a base profile (12) with a proud ball head (22) and a masking profile strip (14) with a socket pointing downwards which is formed from two coaxial walls (34, 36) curved into a circular cylinder. The walls (34, 36) extend around the ball head (22) by more than 180°, so that the two strips (12, 14) can lockingly engage. The masking profile strip (14) can be pivoted to a limited degree, so that inclined positions are possible.

5 Claims, 5 Drawing Sheets

JOINT-MASKING DEVICE AND METHOD OF ASSEMBLING IT

FIELD AND BACKGROUND OF THE INVENTION

The invention relates to a joint-masking device.

A joint-masking device of this type is known from DE-U-86 00241. At the lower end of the supporting limb there are provided enlargement fins the outer surfaces of which lie on an imaginary circular cylinder. The base profile strip has two vertical mounting limbs, the inner surfaces of which face each other and each have a plurality of longitudinal grooves whose bottom surfaces likewise lie in pairs on an imaginary circular cylinder of the same diameter. Depending on the height of the joint to be masked, the ball head of the masking profile strip lockingly engages in a corresponding pair of grooves. The fact that the masking profile is mounted on a ball-type articulation means that it may also assume a certain inclined position, though this is limited to a small angle of pivot. At the bottom, the supporting limb of the masking strip is not supported on the base strip; instead, the wings of the masking strip rest on the neighbouring floor coverings. It would be an ideal coincidence if the ball head were to engage in the lateral grooves of the mounting limbs. It will occur much more frequently that the surfaces of the ball head of the supporting limb will come to rest between two pairs of grooves of the mounting limbs, which means that situations can certainly occur in which the ball head will attempt to escape to the next-higher pair of grooves, so that the masking wings of the masking strip will lift off from the floor coverings. When loads are applied, the masking strip will then move, which is disadvantageous.

FR-A-26 95 671 likewise teaches an articulated way of mounting a masking strip on separate base mounts consisting of nails which have heads whose top surfaces are flat and whose undersides are curved like the roof section of a tunnel. The masking strip has two supporting limbs which are curved to form a mirror image of one another and which engage beneath the heads of the nails. Before assembly, the nails must be pushed into the strip from one end, and assembly is effected by aligning the nails with dowel-holes previously drilled in the floor and then pushing them into said holes by exerting pressure on the masking strip. Between the curved mounting limbs of the masking strip, a V-shaped coupling area is provided on said masking strip, the apical edge of which rests on the flat top surface of each head nail. The strip can be pivoted at the retaining nails to a greater extent than in the first prior art mentioned, though the retaining nails do not guarantee that the masking strip will be supported reliably; rather, said masking strip is deformed when a load is applied, whereby the nails are pressed deeper into their dowels, and, when the load on the masking strip is released, said nails travel back upwards and, because of the elastic deformation of the strip, can even move up beyond their original position, which means that, after a certain time, the strip will no longer be held in position without wobbling. While it would be conceivable to insert a base profile strip into the masking strip instead of the separate head nails, fitting the base strip would then be problematic.

SUMMARY OF THE INVENTION

The object of the invention is to provide a joint-masking device which ensures that the masking profile strip is firmly supported on the base profile strip according to the principle of a ball head and socket, so that the masking device can be used as a transition profile both between coverings of the same height and for coverings of different heights, with the masking profile strip assuming an inclined angle; a further object of the invention is that it should be impossible for the connection between the two strips to come loose and that the joint-masking device should be quick and unproblematic to assemble.

Although a ball head can also be provided at a lower end of the supporting limb of the masking profile strip, it nevertheless preferably forms the upper end of the mounting stem of the base profile strip. Since the cylindrical outer surface of the ball head extends around approx. 135° and reaches as far as the narrow mounting stem, and since the concave cylindrical surface of the socket extends around more than 180° and is preferably formed between two thin walls of the masking profile strip, a broad supporting area is created in the articulation portion between the two strips, whose projection onto the plane of the mounting stem of the base profile strip is equal to the diameter, i.e. the broadest dimension, of the ball head. The novel joint-masking device can thus also be used for very wide joints where the edges of the masking wings resting on the floor coverings would be deformed if the supporting limb were not firmly supported on the mounting stem. The novel joint-masking device permits the masking profile strip to assume an angle of inclination of 30° or more and can therefore also be used as a skirting-board. The socket engages beneath the ball head to such an extent that the articulated joint is reliably prevented from coming loose of its own accord. Using a suitable tool, however, it is indeed possible to unlatch the strip and lock it back in place again.

One very advantageous further embodiment comprises a section of mounting profile strip having two parallel outer locating areas facing away from one another which terminate in a bottom plane at right angles to them, with a receiving chamber opening at said bottom plane, said receiving chamber having a profile which is at least approximately the same as the interior cross-section of the socket of the masking profile strip. This mounting profile is used for masking joints where the base profile strip carries the ball head. For the alternative in which the ball head is provided on the masking profile strip, the mounting profile is adapted accordingly, so that a ball head is provided instead of the receiving chamber, said ball head then being caused to engage with the socket of the base profile strip, i.e. it can preferably be releasably locked together with it. A section of mounting profile strip of this kind is essential for this version of the invention.

With one or preferably a plurality of sections of mounting profile strip, the joint-masking device of the invention can be mounted very precisely by causing the mounting profile or preferably the plurality of mounting profiles to engage, with their part of the articulated joint, with the complementary articulated joint on the mounting stem of the base profile strip and pushing said base profile strip on a fixing surface on the floor or wall into a position in which the section of mounting profile strip is supported with one of its locating areas on a portion of the floor or wall at right angles to the fixing surface, fixing, i.e. in particular screwing, said base profile strip to said fixing surface in this position, and, after removing the at least one section of mounting profile strip from the articulated joint of the base profile strip, clipping the masking profile strip on said base profile strip. The sections of mounting profile strip also act as wall spacers for laying the first row of parquet or tile flooring. In this latter case, an additional supporting area on the section of mounting profile strip is used. With this method according to the invention, the base profile strip can be screwed or nailed in exactly the correct position relative to the finished covering to ensure that the clipped-on masking profile strip forms a perfect fit.

BRIEF DESCRIPTION OF THE DRAWINGS

The invention will now be described in detail with reference to the drawing, which illustrates embodiments.

FIG. 11 shows a section of a masking profile strip with masking limbs of different lengths, one of which is bent at an angle.

DESCRIPTION OF THE PREFERRED EMBODIMENT

Figure 3:
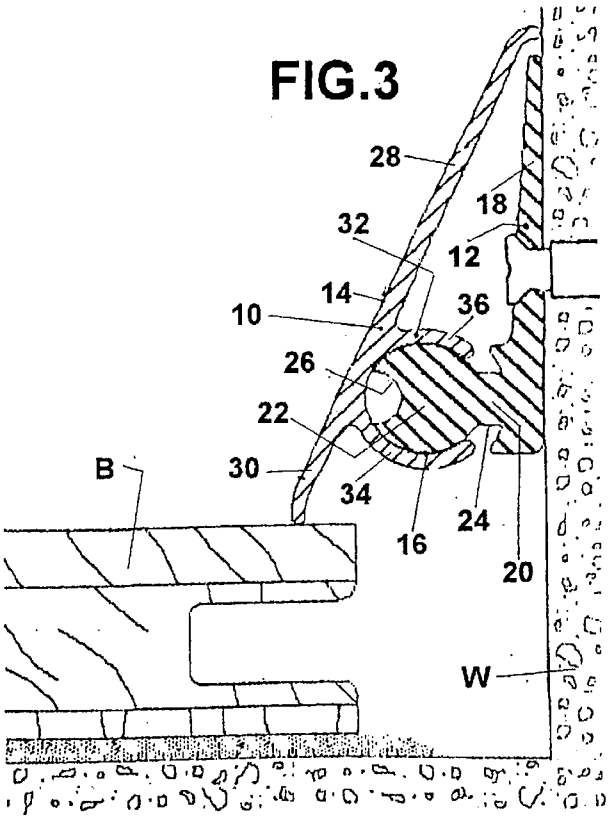
FIG. 3 shows a section through the finished joint-masking device with a base profile strip and masking profile strip.

A joint-masking device 10 consists of a base profile strip 12 and a masking profile strip 14 which are connected together by a ball head and socket joint 16. The base profile strip 12 has a horizontal, conically tapering fixing limb 18 and a vertical mounting stem 20 which terminates at the top in a ball head 22. Between the ball head 22 and the mounting stem 20 there is a stem projection 24 which narrows like a neck. Diametrically opposite this, the ball head has a longitudinal groove 26. With the exception of the latter and the stem projection 24, the outer surfaces of the ball head 22 lie on a circular cylinder.

In accordance with FIG. 3, the masking profile strip 14 has two masking limbs 28, 30 of different lengths, between which there is, on the underside, a two-armed supporting limb 32 the two arms of which form walls 34, 36 which are arcuate in shape and whose inner surfaces are coaxial, the internal diameter of the supporting limb 32 matching the external diameter of the ball head 22. The circular cylindrical inner surfaces of the two walls 34, 36 adjoin one another flush between the two masking limbs 28, 30. The supporting limb 32 with its two curved walls 34, 36 forms a socket.

The two curved walls 34, 36 of the socket each extend from the portion of the masking strip around a circumferential angle of more than 90°. Between the ends of the two curved walls 34, 36 there is an opening 38 (FIG. 11) which is less wide than the internal diameter of the socket. This means that, when the masking profile strip 14 is being slipped on, pressure needs to be applied in order to force the two walls 34, 36 apart. These then snap back in the final position of the masking profile strip 14 around the ball head 22 of the base profile strip 12. The two strips 12, 14 are thus engaged and locked in place. Nevertheless, it still remains possible to pivot the masking strip 14 about the axis of the ball head 22 of the base profile strip 12.

As FIG. 3 makes clear, the longer masking limb 28 rests on the wall, which is shown here without a covering. If there were a covering of tiles present, the masking profile strip 14 would assume a position pivoted in an anti-clockwise direction, and the masking limb 28 would rest against the covering, which for its part covers the fixing limb 18 of the base profile strip 12.

Figure 2:
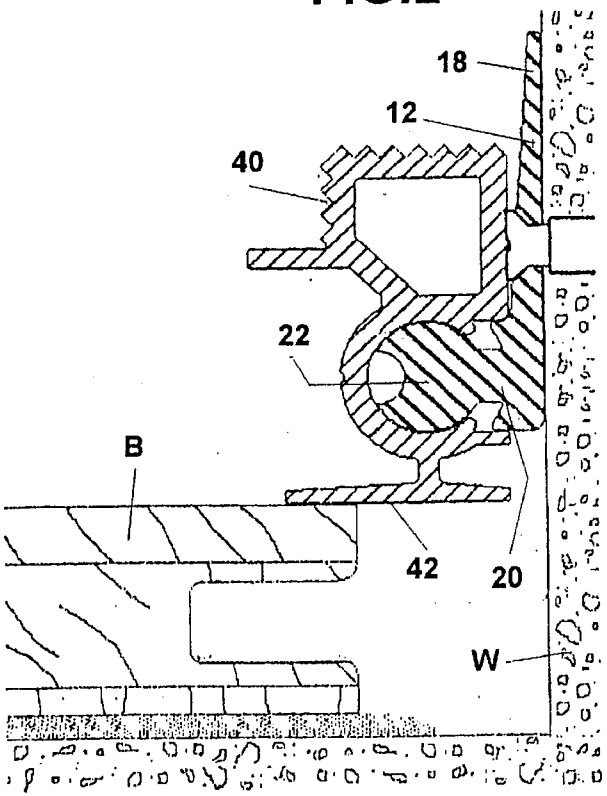
FIG. 2 shows a section of the section of mounting profile strip of FIG. 1 once mounted on a base profile strip in order to position said base profile strip at the correct distance from the floor and to fix it to the wall.
Figure 1:
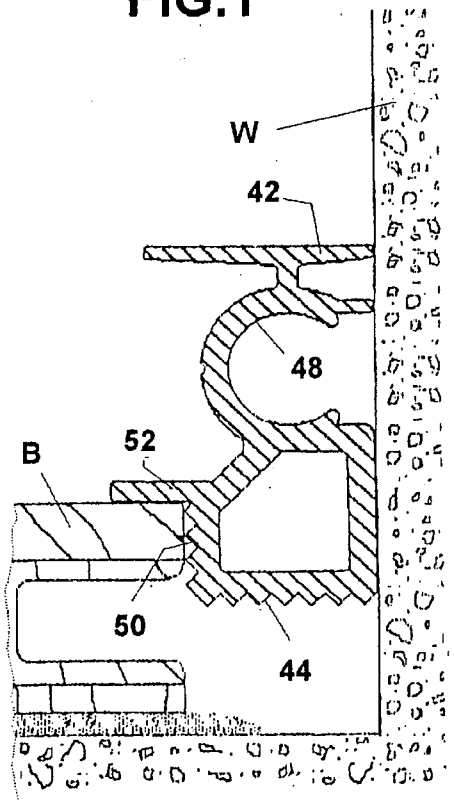
FIG. 1 shows a section of mounting profile strip in cross-section at the beginning of mounting some floor covering.

FIGS. 1 and 2 illustrate a section of mounting profile strip 40 which can be connected to the base profile strip 12 and greatly facilitates dimensioning the joints and masking them. A section of mounting profile strip of this kind has two parallel locating areas 42, 44, one of which is provided with longitudinal grooves. Said two locating areas 42, 44 terminate at a bottom plane 46 which is at right angles to the locating areas. A receiving chamber 48 for the ball head 22 of the base profile strip 12 opens at said bottom plane 46. The internal contour of said receiving chamber 48 corresponds to that of the socket on the supporting limb 32 of the masking profile strip 14. The two locating areas 42, 44 are at unequal distances from the centre of the receiving chamber 48. Adjoining the locating area 44 which is further away from said centre there is a supporting area 50 at right angles to said locating area and thus parallel to the bottom plane 46. The width of said supporting area 50 is less than that of the locating areas 42, 44. The end of said supporting area 50 is defined by a fin 52 joined on at right angles, with a third locating area formed thereupon, parallel to the two locating areas 42, 44.

As FIG. 1 illustrates, the supporting area 50 of the section of mounting profile strip 40 serves to support a floor B, which is shown here as parquet. For this purpose, a plurality of sections of mounting profile strip are arranged in a row so that the row of parquet elements is positioned such as to be spaced apart from the wall. Once the floor covering B is finished, the sections of mounting profile strip 40 are removed and slipped onto a base profile strip 12, as illustrated in FIG. 2. In the process, the ends of the U-shaped limbs of the receiving chamber 48 extend over and engage the mounting stem 20 of the base profile strip 12, so that it is not possible for them to pivot out of position relative to one another. After all the sections of mounting profile strip 40 have engaged on the ball head 22 of the base profile strip 12, they are pushed onto the covering B together with the base profile strip 12 until the fixing limb 18 of said base profile strip is touching the wall W. In this position, the base profile strip 12 is screwed tight to the wall between two sections of mounting profile strip 40 in each case. Relative to the floor covering B, the base profile strip 12 is then located at a precisely predetermined distance, which is appropriate for the associated masking profile strip 14. When the sections of mounting profile strip are in the position shown in FIG. 2, it is also possible to lay a tile covering, with the locating area 44 of the sections of mounting profile strip 40 then serving to align and support the lowest row of tiles.

Figure 4:
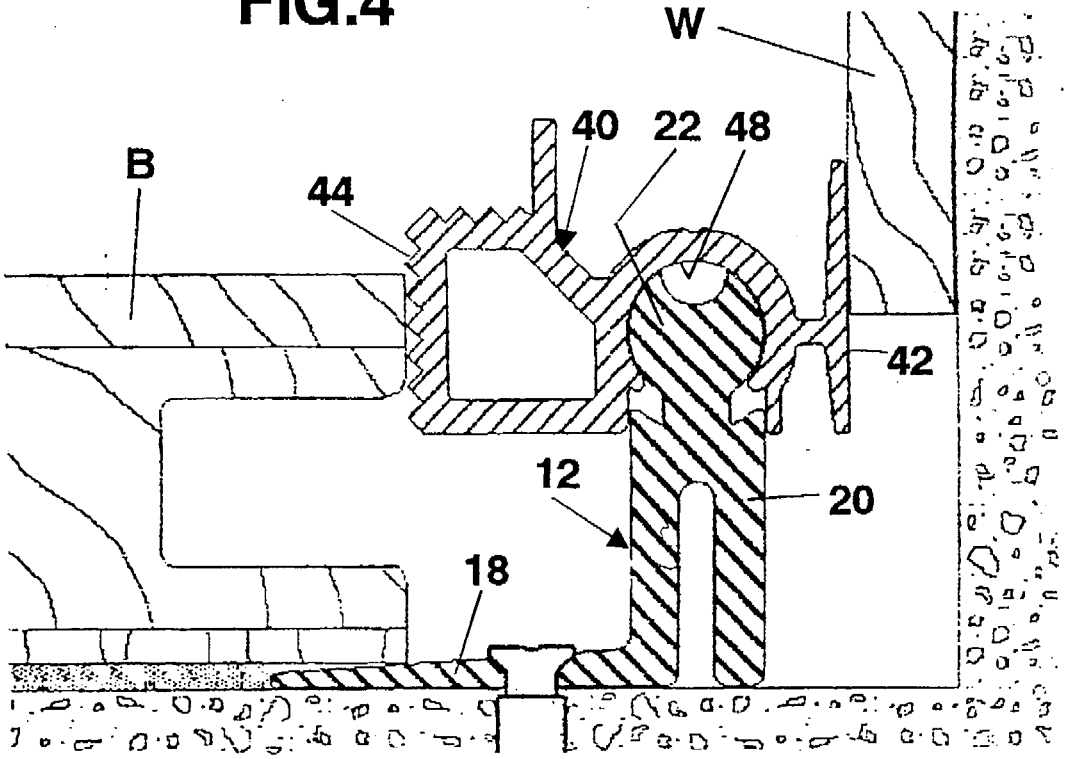
FIG. 4 shows a section through a base profile strip for higher floor coverings with a section of mounting profile strip riding on it.

FIG. 4 shows the parquet assembly just described, though with a base profile strip 12 having a higher mounting stem 20. Because of this greater height, it has a two-armed design for reasons of stability. The height of the floor covering B in FIGS. 4 and 5 corresponds approximately to the level of the ball head 22 of the base profile strip 12, so that the masking profile strip 14 is almost horizontal in the assembled position. The same profile strips 12, 14 can also be used for thinner floor coverings B in FIG. 5. In that case, the masking profile strip 14 would assume a correspondingly angled position.

Figure 5:
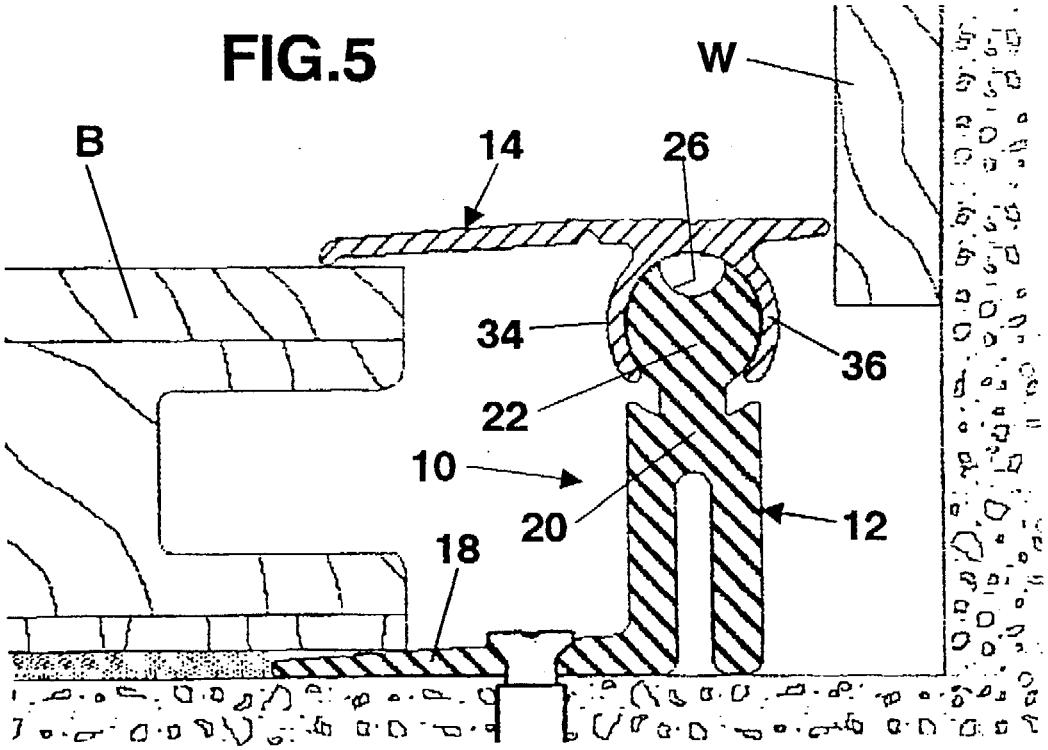
FIG. 5 shows a section similar to that of FIG. 4 after the section of mounting profile strip has been removed and a masking profile strip has been placed on it.
Figure 6:
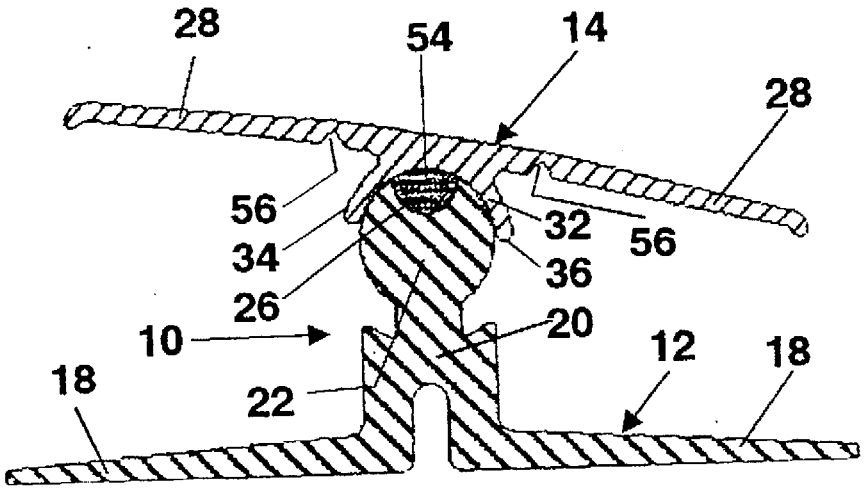
FIG. 6 shows a section through a modified joint-masking device.

The masking profile strip 14 of FIG. 6 likewise has a two-armed supporting limb 32, though the walls 34, 36 of said supporting limb are shorter than those of the embodiment shown in FIGS. 3 and 5, so that they encompass a circumferential angle of less than 180°. Nevertheless, said supporting limb 32 likewise forms a socket for the ball head 22 of a fixing limb 12, which differs from that of the above-described embodiment in accordance with FIGS. 3 and 5 in that it has a mounting stem 20 of medium height and two fixing limbs 18 facing away from one another. The height of the mounting stem 20 of FIG. 6 is between that of the mounting stem 20 of FIG. 3 and those of FIGS. 4 and 5. Because the curved walls 34, 36 are shorter, the masking profile strip 14 cannot be locked in engagement with the base profile strip 12, which is why a different kind of connection is provided. In the embodiment of FIG. 6, the longitudinal groove 26 contains an adhesive thread 54. In this embodiment, the masking profile strip 14 must be placed in its final inclined position on the ball head 22 of the base profile strip 12 and pressed there, because it will then no longer be possible subsequently to pivot it. While this embodiment with a shorter circumferential extent of the socket dispenses with the clamping or locking engagement principle, it nevertheless makes it possible to pivot the masking profile strip to a greater extent and thus forms part of the essential element of the invention as an alternative. The masking limbs 28, which are shown here as being identical in length, have, adjacent to the socket-supporting limb 32, bending grooves 56 on the underside allowing the masking limbs 28 to bend. These make it possible finely to adjust the joint-masking device to the covering levels on both sides, by supplying the masking limbs 28 or at least one masking limb 28 bent forward along the bending groove 56 towards the adjacent section of strip, i.e. folded (cf. FIGS. 9 and 11), so that it bends back accordingly when the masking profile strip 14 is clipped on, thereby ensuring that the masking limb 28 rests firmly on the coverings with resilient pre-tensioning.

Figure 7:
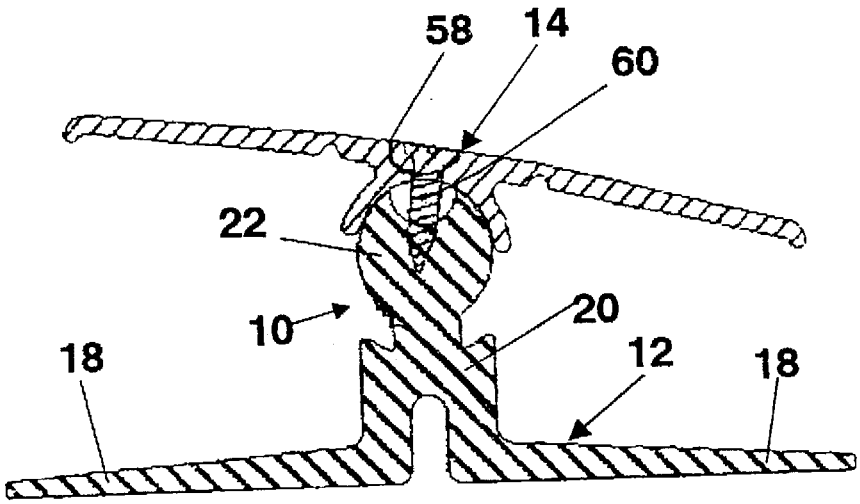
FIG. 7 shows a section through a further modification of a joint-masking device.

FIG. 7 illustrates a masking profile strip 14 which corresponds to that of FIG. 6 with regard to the design of the socket. In the central longitudinal plane of the socket, the masking profile strip 14 has bore holes spaced apart longitudinally, through which screws 60 can be screwed into the ball head 22 of the base profile strip 12. In every pivoted position of the masking profile strip 14, the screws 60 intersect the axis of the socket profile.

The adhesive connection of FIG. 6 and/or the screwed connection of FIG. 7 can also be used with the locking engaged connection of the joint-masking device 10 in accordance with FIG. 3.

Figure 8:
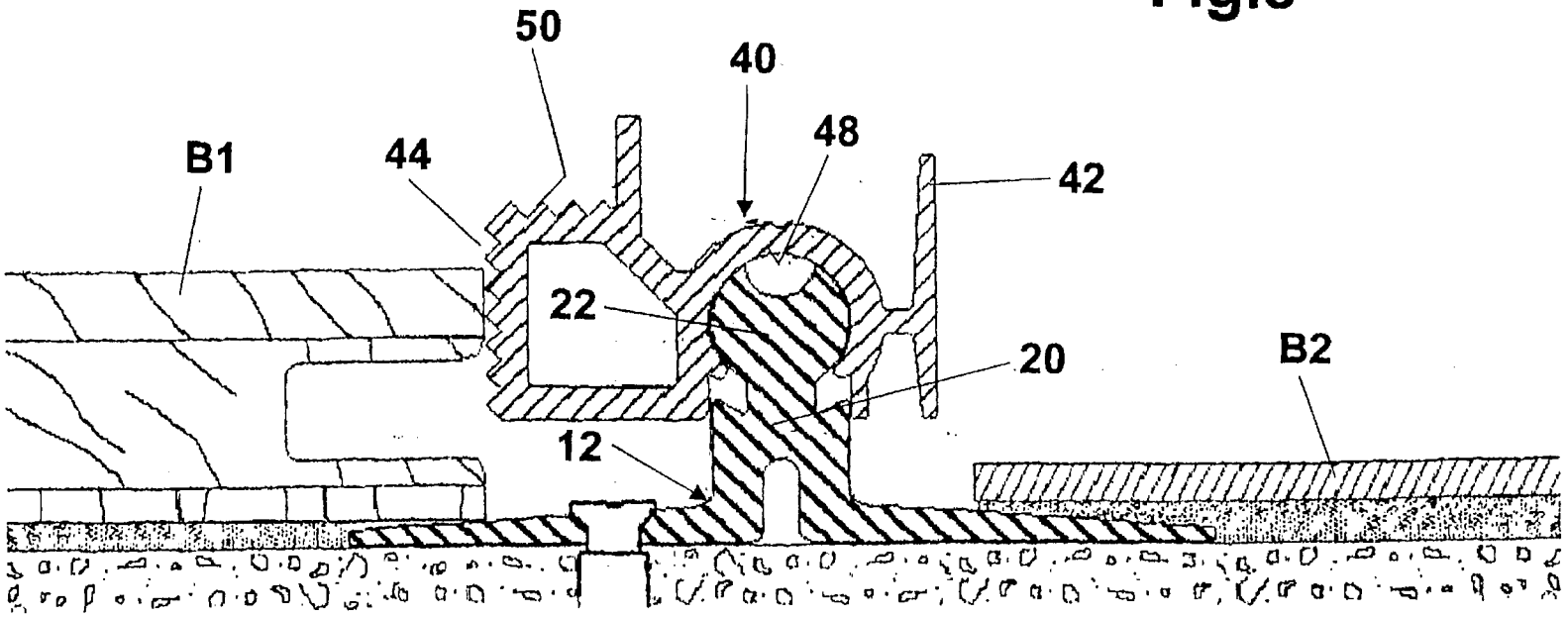
FIG. 8 shows a section through a modified base profile strip for a transition from one covering to the next, with a section of mounting profile strip placed on it.
Figure 9:
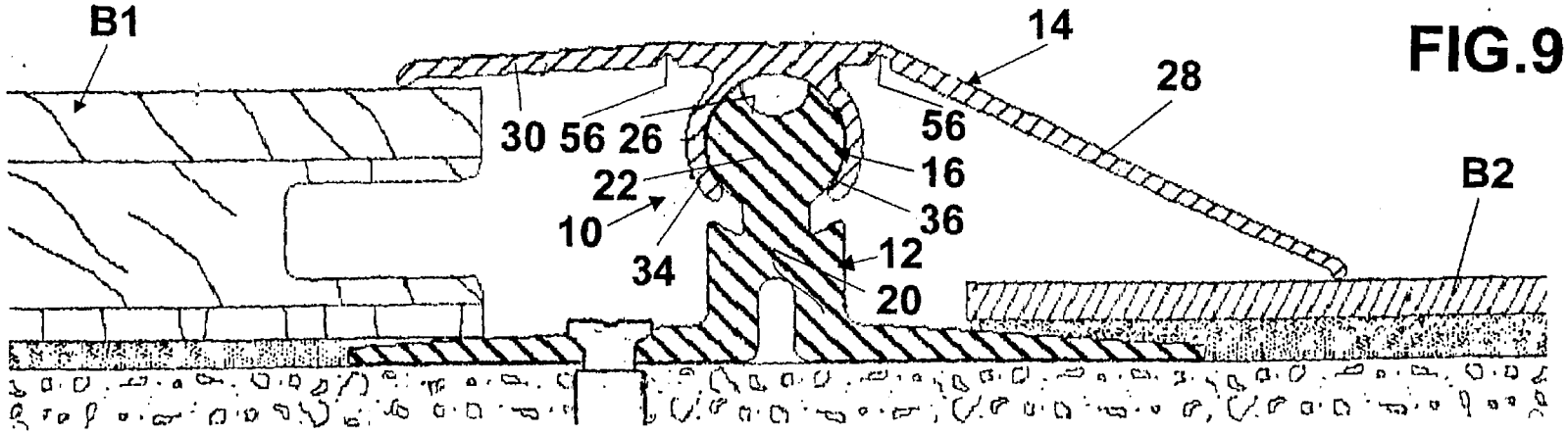
FIG. 9 shows a section through a joint-masking device for two floor coverings of different levels.

FIGS. 8 and 9 illustrate the masking of a transition joint between two coverings B1 and B2 of different heights. The base profile strip 12 used is that of FIGS. 6 and 7. The masking profile strip 14 corresponds to that of FIG. 3, except that the shorter of the two masking limbs 28, 30 is longer and both masking limbs have the bending grooves 56 on the underside. Before the masking profile strip 14 is mounted, the shorter masking limb 30 is bent down slightly and the longer masking limb 28 is bent down substantially about their respective bending grooves 56. Upon assembly, the two masking limbs 28, 30 bend back about their bending grooves 56, i.e. upwards, so that they rest resiliently pre-tensioned on the coverings B1 and B2.

The sections of mounting profile strip 40 of FIG. 8 make it possible to align the first row of covering elements of the floor covering B1 in the correct position. If, instead of the base profile strip 12 of medium height, the base profile strip of low height in accordance with FIGS. 2 and 3 were used, the masking limb 30 would not need to be bent down at all, and the masking limb 28 would need to be bent down to a considerably lesser extent, and the locating area 42 of the sections of mounting profile strip 40 could also be used to rest on the floor covering B2.

Figures 10, 12, 13, 14, 15:
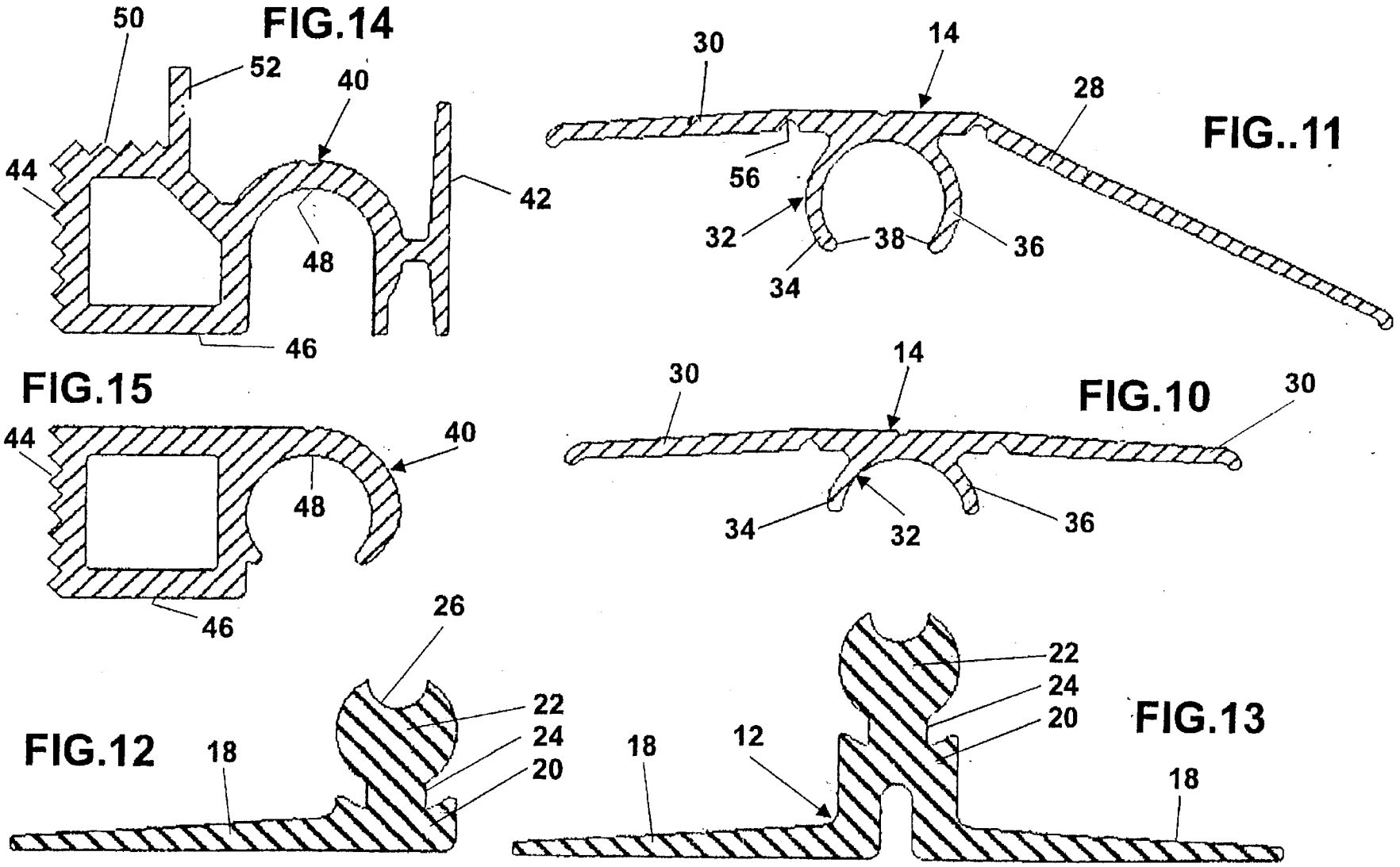
FIG. 10 shows the cross-section of a masking profile strip with masking limbs of approximately equal lengths.
FIG. 12 shows a section through a base profile strip with a fixing limb in a horizontal position.
FIG. 13 shows a section through a modified embodiment of a base profile strip with two fixing limbs.
FIG. 14 shows a section through a section of mounting profile strip in a modified presentation.
FIG. 15 shows a modified section of mounting profile strip with only one fixing surface.

FIGS. 10 and 13 illustrate the masking profile strip 14 and the base profile strip 12 as single parts. FIG. 11 shows the masking profile strip 14 as a single part with a masking limb 28 bent down. FIG. 12 shows the base profile strip 12 with the lowest embodiment of the mounting stem 20. FIG. 15 shows a section of mounting profile strip 40 with only one locating area 44. The form of the socket ends at the opposite side of the piece of strip. The base profile strip of FIG. 12 and the sections of mounting profile strip in accordance with FIG. 15 can be mounted extremely close to the wall. FIG. 14 shows an advantageous modification of the section of mounting profile strip 40 in that the receiving chamber 48 has a U-shaped contour, with two planar parallel vertical surfaces adjoining a semi-cylindrical curved surface. This section of mounting profile strip 40 can simply be placed on the ball head 22 from above so that it overlaps the mounting stem 20. It does not lock on the ball head and can therefore also be removed without any force, so that no excessive leverage forces are applied to the base profile strip 12.

We claim:

1. Joint-masking device with a base profile strip (12) having at least one horizontal fixing limb (18) and at least one vertical mounting stem (20), and with a masking profile strip (14) having at least one horizontal masking limb (28, 30) and a supporting limb (32) extending downwardly from the masking limb said masking profile strip being connected to the base profile strip (12) by a positive interlocking fit of the supporting limb (32) on the mounting stem (20), the connection between the mounting stem and supporting limb (20, 32) which effects the positive interlocking fit being designed as a locking ball head and socket joint (16) having an articulation axis running in a longitudinal direction of the strip for mounting the masking profile strip (14) on the base profile strip (12) in various pivoted positions, characterized in that the ball head (22), on a free end of the mounting stem (20), has a circular cylindrical outer surface interrupted by a longitudinal groove (26), said outer surface having a circumferential angle of more than 180° and being disposed coaxially to said articulation axis and extending on both sides of a plane containing said articulation axis and lying parallel to the fixing limb (18); that the supporting limb (32) has two thin walls (34, 36) each wall having an end and an inner surface, the walls being curved to form a mirror image of one another, with a circumferential gap (38) formed between the ends of the walls, the gap having a width which is smaller than the diameter of the ball head (22) by an amount lying within the range of the elastic spreading of the walls (34, 36); and that the inner surfaces of the curved walls (34, 36) and an intermediate area connecting the inner surfaces form a continuous circular cylindrical surface having a circumferential angle of more than 180°, a curved supporting area for the masking profile strip (14) being formed between the ball head (22) and the socket (32), said supporting area being interrupted by the longitudinal groove (26) and extending about at least half the circumference of the ball head (22), and the size of the supporting area is the same in the various pivoted positions of the masking profile strip (14).

2. Joint-masking device as claimed in claim 1, characterised in that an adhesive thread (54) is placed in the longitudinal groove (26) of the ball head (22).

3. Joint-masking device as claimed in claim 1, characterised in that the masking profile strip (14) has holes (58) spaced apart longitudinally which lead into the space delimited by the curved walls (34, 36) of the masking profile strip (14).

4. Joint-masking device as claimed in claim 1, characterised in that the stem of the ball head (24) formed between the ball head (22) and its mounting stem or supporting limb (20; 32) is constricted like a neck.

5. Joint-masking device as claimed in claim 1, characterised in that the masking profile strip (14) has, in the region of at least one masking limb (28, 30), a longitudinal groove (56) on the underside about which the masking limb (28, 30) opposite a portion of strip bearing the supporting limb (32) is bent down to a further degree before assembly than in the assembled position of the masking profile strip (14).

* * * * *